US010525371B1

(12) United States Patent
Hsu et al.

(10) Patent No.: US 10,525,371 B1
(45) Date of Patent: Jan. 7, 2020

(54) BLADELESS BUBBLE FAN

(71) Applicant: Lorraine Melody Hsu, Santa Ana, CA (US)

(72) Inventors: Lorraine Melody Hsu, Santa Ana, CA (US); Connie Wang, Santa Ana, CA (US)

(73) Assignee: Lorraine Melody Hsu, Santa Ana, CA (US)

( * ) Notice: Subject to any disclaimer, the term of this patent is extended or adjusted under 35 U.S.C. 154(b) by 0 days.

(21) Appl. No.: 16/188,160

(22) Filed: Nov. 12, 2018

Related U.S. Application Data

(60) Provisional application No. 62/589,659, filed on Nov. 22, 2017.

(51) Int. Cl.
*A63H 33/28* (2006.01)
*B01F 3/04* (2006.01)
*F04D 25/08* (2006.01)

(52) U.S. Cl.
CPC ..... *A63H 33/28* (2013.01); *B01F 3/04007* (2013.01); *F04D 25/084* (2013.01)

(58) Field of Classification Search
CPC ..... A63H 33/28; B01F 3/04; B01F 3/04007
See application file for complete search history.

(56) References Cited

U.S. PATENT DOCUMENTS 9,878,262 B2 * 1/2018 Chan ..... A63H 33/28

* cited by examiner

*Primary Examiner* — Robert A Hopkins
(74) *Attorney, Agent, or Firm* — Goldberg Cohen LLP

(57) ABSTRACT

A bladeless bubble fan includes a housing defining a plurality of inlets and having enclosed therein an impeller for drawing air through the inlets from an exterior thereof, at least a portion of the housing forming a closed geometrically shaped outer shell and defining an axial passageway therethrough. An inner air guide is received in the housing and coaxial with the closed geometrically shaped outer shell and in combination with the outer shell defines a plenum therebetween in fluidic communication with an output of the impeller and further defines a peripheral outlet of the plenum. A bubble ring is affixed to the inner air guide and coaxial therewith. The bubble ring has a plurality of closely spaced fins extending inwardly toward an axis of the axial passageway.

19 Claims, 8 Drawing Sheets

BLADELESS BUBBLE FAN

BACKGROUND OF THE INVENTION

Soap bubbles have been entertaining children and even adults for hundreds of years. Old paintings have shown children blowing bubbles with clay pipes. Children enjoy playing with bubbles outdoors and even indoors such as during bath time. Beginning in the mid-twentieth century bottles of bubble solution were produced and marketed as a children's toy.

A bubble is made of transparent water enclosing transparent air. The water is typically soap film comprising a solution of water, soap such as dish soap, and glycerin. The soap film defining a bubble is as thin as the visible light wavelength which results in interferences of light reflecting off the front and back surfaces of the thin soap film. These interferences create different colored iridescence which, together with the bubble's spherical shape and fragility, contributes to the magical effect on children and adults alike. Each color perceived in the bubble is the result of varying thicknesses of the soap bubble film.

In lieu of clay pipes used in previous years, the marketed bubble solution also typically includes a wand of wire or plastic. The wand has a circular loop, or a loop of a different geometry, at one end and a handle for grasping at an opposite end. The circular loop is dipped into the soap solution and carefully withdrawn. A film of soap solution will extend between the inner peripheries of the loop. The wand can then be gently waved through the air. The movement of the wand creates a gentle airflow through the loop to create and expel bubbles from the backside of the wand. Often a plurality of bubbles can be created with a single dip of the wand into the soap solution. The most successful bubble production is realized if the airflow through the wand loop is relatively laminar instead of turbulent.

Enjoyment of producing bubbles increases with the number of bubbles able to be formed. While bubble machines are available, they can be often large and thus not portable, and the machines are complex for a child to operate. Therefore, there is a need for a device able to mechanically produce quantities of bubbles and further wherein the device is portable and child friendly.

SUMMARY OF THE INVENTION

In accordance with the invention a device is provided in the form of a bladeless bubble fan, the device being for blowing bubbles and preferably for use as a toy. In particular, consistent with the invention, a toy is provided for blowing bubbles, in which no blades are used for blowing air to create bubbles. Although various preferred embodiments are discussed herein, any further shape and configuration of components that achieves the goals of a bladeless bubble fan can be provided consistent with the invention.

In accordance with a preferred embodiment of the invention a bladeless bubble fan includes a housing defining a plurality of inlets and having enclosed therein an impeller for drawing air through the inlets from an exterior thereof, at least a portion of the housing forming a closed geometrically shaped outer shell and defining an axial passageway therethrough. In one preferred embodiment, the outer shell is preferably circular. Alternatively, it can be any closed geometric shape. Further alternatively, the outer shell can be an open geometric shape.

An inner air guide is received in the housing and coaxial with the closed geometrically shaped outer shell and in combination with the closed geometrically shaped outer shell defines a plenum therebetween in fluidic communication with an output of the impeller and further defines a peripheral outlet of the plenum. A bubble ring is affixed to the inner circular air guide and is coaxial therewith. The bubble ring has a plurality of closely spaced fins extending inwardly toward an axis of the axial passageway. In preferred embodiments, the air guide, bubble ring, and/or plenum are circular or oval, although other shapes can be used consistent with the invention.

In another aspect, the bladeless bubble fan housing includes a handle extending from the outer shell.

In still another aspect, the bladeless bubble fan inlets are defined in the handle and the impeller is mounted in the handle.

In yet another aspect, an electric motor is mounted in the handle and oriented to drive the impeller.

In a still further aspect, the peripheral outlet of the plenum is defined by a leading edge of the outer shell and a leading edge of the inner air guide.

In another aspect, the peripheral outlet is oriented to direct airflow from the peripheral outlet through the axial passageway.

In a further aspect, the bubble ring is affixed at an outlet of the axial passageway.

In a still further aspect, the circular bubble ring includes an inner flange extending inwardly toward the axis of the axial passageway.

In yet another aspect, the plurality of closely spaced fins are formed upon the inner flange and radially aligned with the axis of the axial passageway.

In another aspect, adjacent ones of the closely spaced fins define a slot therebetween for receiving and retaining a liquid bubble solution.

In still another aspect, the bladeless bubble fan further includes a bubble pan attached to and selectively detachable from a trailing edge of the inner air guide for receiving a liquid bubble solution.

In yet another aspect, the bubble pan defines a trough for receiving the liquid bubble solution.

In another aspect, a bladeless bubble fan includes a housing defining a plurality of inlets and has enclosed therein an impeller for drawing air through the inlets from an exterior thereof. At least a portion of the housing forms a closed geometrically shaped outer shell defining an axial passageway therethrough. An inner air guide is received in the housing and is coaxial with the closed geometrically shaped outer shell. The inner air guide in combination with the closed geometrically shaped outer shell defines a plenum therebetween in fluidic communication with an output of the impeller wherein a leading edge of the closed geometrically shaped outer shell and a leading edge of the inner air guide define a peripheral outlet of the plenum. A bubble ring is affixed to the inner air guide at an outlet of the axial passageway and coaxial therewith. The bubble ring has a plurality of closely spaced fins extending inwardly toward an axis of the axial passageway.

In still another aspect, the housing includes a handle extending from the closed geometrically shaped outer shell.

In yet another aspect, the inlets are defined in the handle, and an electric motor and the impeller rotatingly attached thereto are mounted in the handle.

In a still further aspect, the peripheral outlet is oriented to direct airflow from the peripheral outlet through the axial passageway.

In another aspect, the bubble ring includes an inner flange extending inwardly toward the axis of the axial passageway.

In another aspect, the plurality of closely spaced fins are formed upon the inner flange and are radially aligned with the axis of the axial passageway, and further wherein adjacent ones of the closely spaced fins define a slot therebetween for receiving and retaining a liquid bubble solution.

In a still further aspect, the bladeless bubble fan further includes a bubble pan attached to and selectively detachable from the trailing edge of the inner circular air guide, the bubble pan defining a trough for receiving a liquid bubble solution.

In yet another aspect, a bladeless bubble fan is provided which includes a housing having a handle defining a plurality of inlets and enclosing a battery compartment, a motor, and an impeller for drawing air through the inlets and expelling the air through a top of the handle. An outer circular shell is attached to an upper end of the handle and defines an axial passageway therethrough. An inner circular air guide is received in the circular outer shell and in combination with the outer shell defines a circular plenum thereabout in fluidic communication with the top of the handle. A leading edge of the inner circular air guide and a leading edge of the outer circular shell define a peripheral outlet of the plenum wherein the peripheral outlet is oriented to direct airflow from the peripheral outlet through the axial passageway. A circular bubble ring is affixed to the trailing edge of the inner circular air guide and is coaxial therewith. The bubble ring has an inner flange extending inwardly toward an axis of the axial passageway and a plurality of closely space fins formed thereupon. The fins are radially aligned with respect to the axis. Each fin in combination with an adjacent fin defines a slot therebetween for receiving and retaining a liquid bubble solution. A bubble pan is attached to and selectively detachable from the trailing edge of the inner circular air guide and defines an annular trough for receiving a liquid bubble solution.

Further embodiments and features of the invention will become apparent in conjunction with the detailed description of the inventions and their preferred embodiments provided hereafter.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
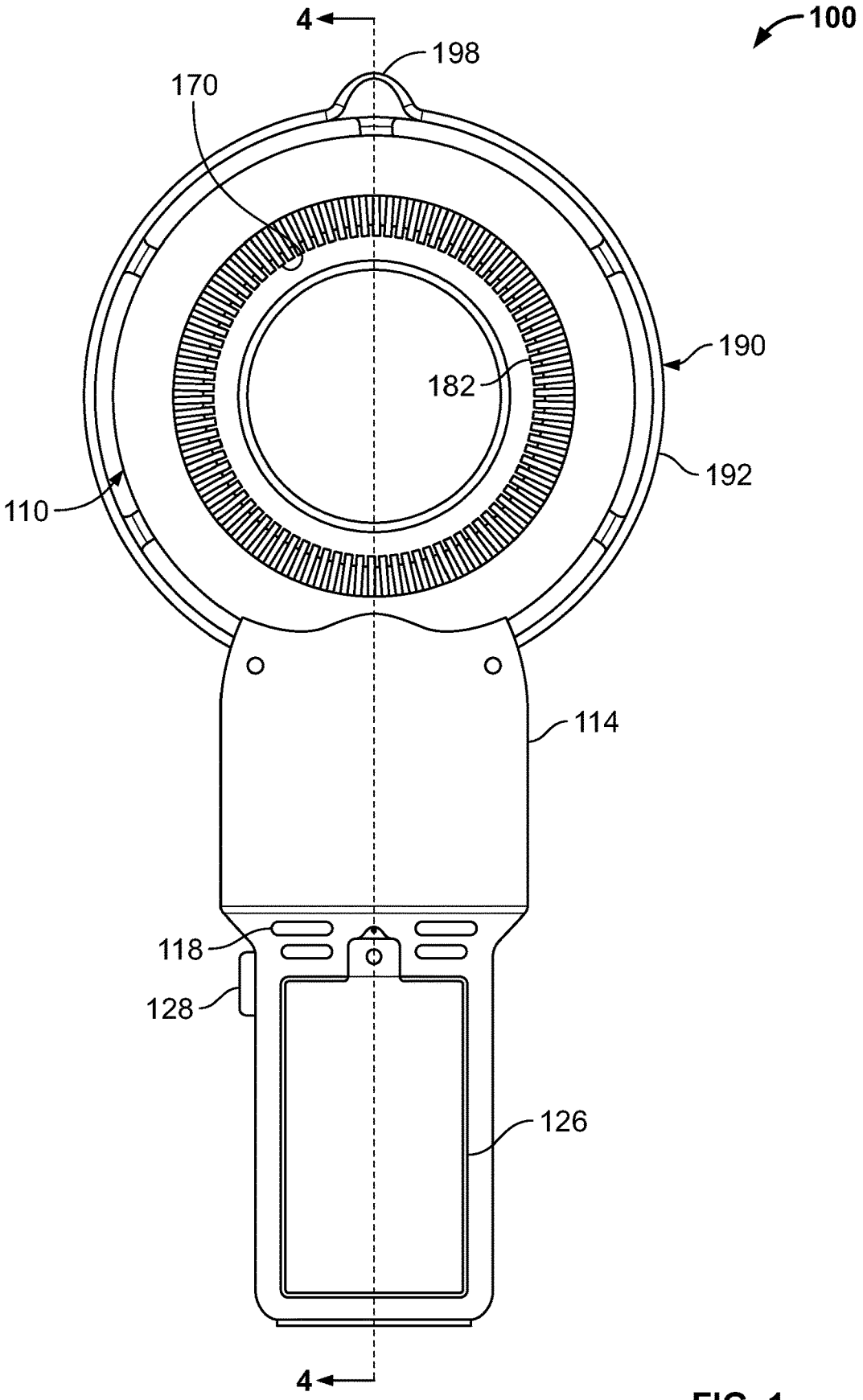
FIG. 1 presents an elevation view of a bladeless bubble fan embodying the present invention viewed toward the mouth of the bladeless fan.
Figure 2:
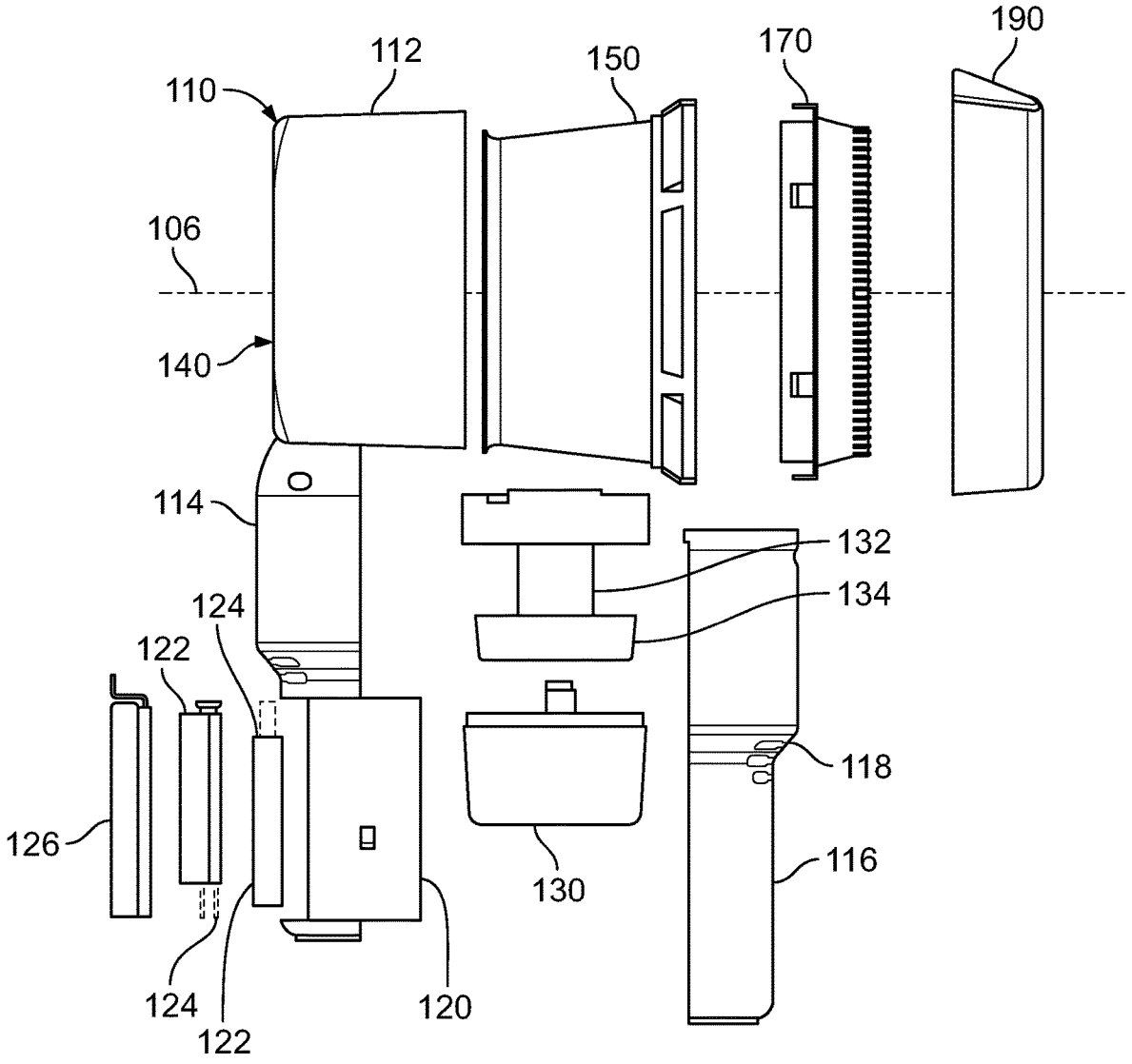
FIG. 2 presents an exploded side view of the bladeless bubble fan of FIG. 1.
Figure 3:
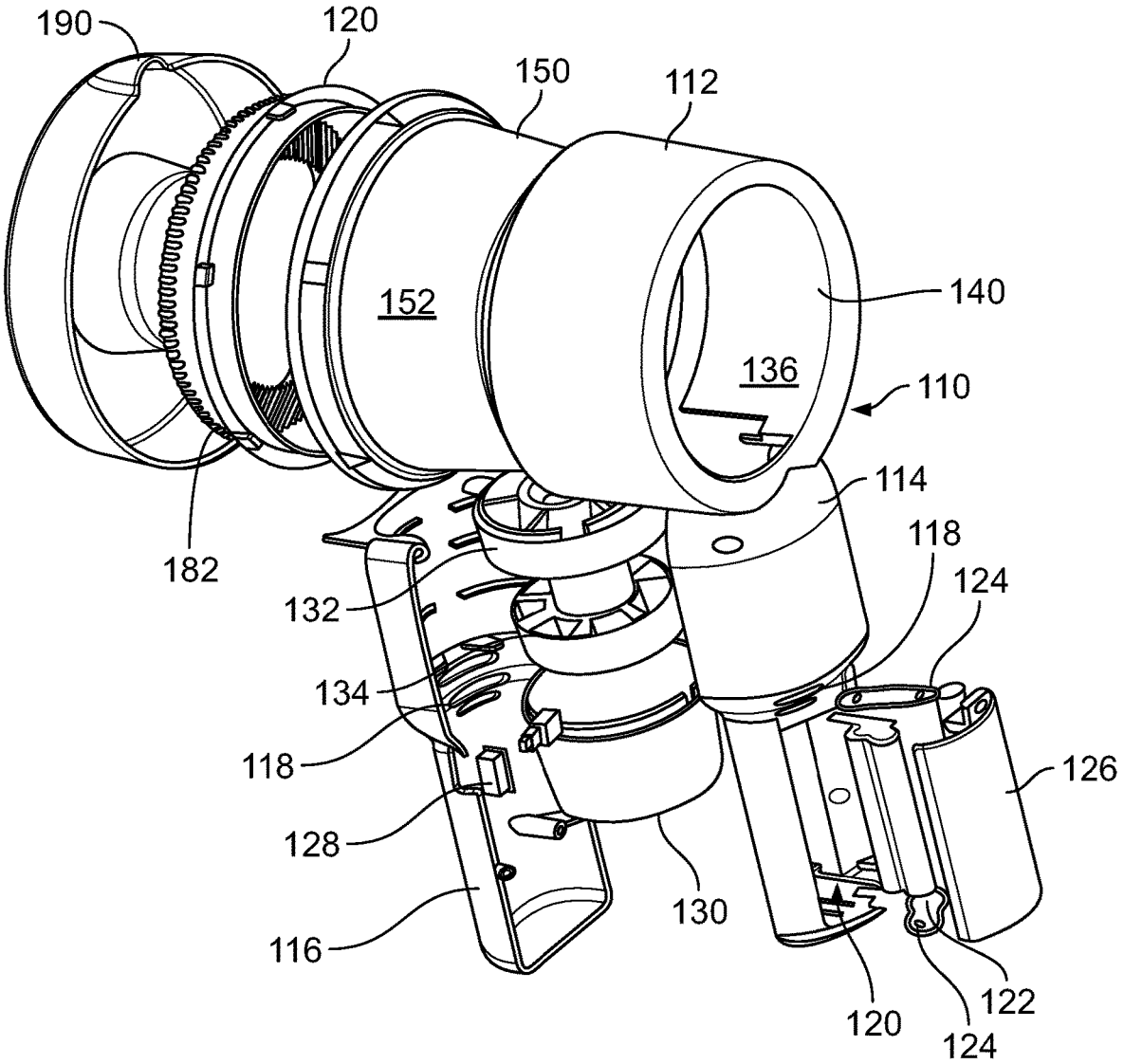
FIG. 3 presents a top isometric exploded view of the bladeless bubble fan of FIG. 1.
Figure 4:
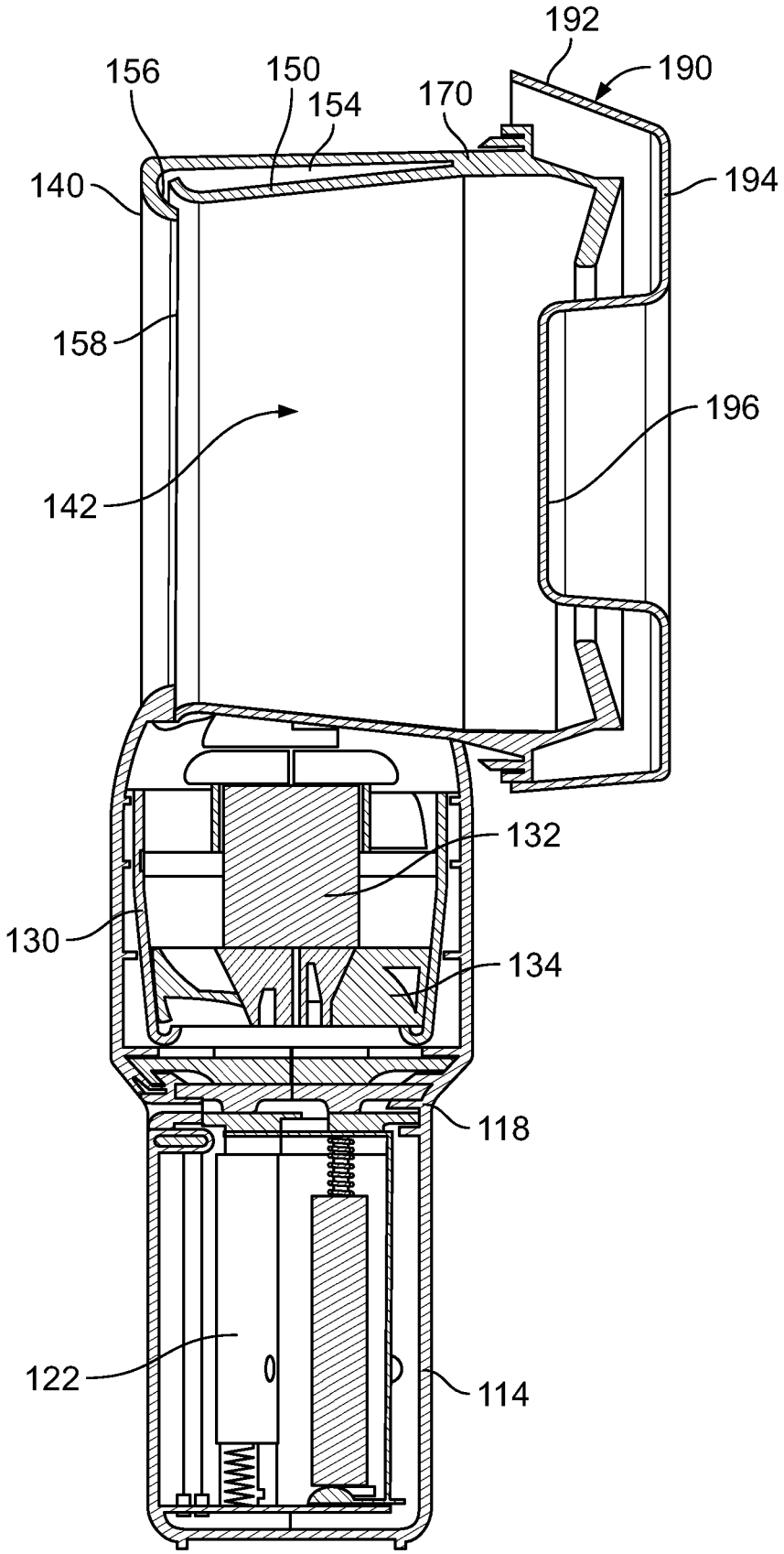
FIG. 4 presents a cross-sectional view of the bladeless bubble fan shown in FIG. 1 and taken along the line 4-4, FIG. 1.

The invention relates to the field of entertainment and toy apparatuses. More specifically, the invention relates to an apparatus for creating a plurality of soap bubbles. The apparatus includes a bladeless fan such as one taught in U.S. Pat. No. 8,197,226 B2. A circular housing defines an axial air passageway extending from a mouth of the circular housing to an exit. A bubble ring for retaining a bubble solution between adjacent ones of a plurality of fins is attached at the peripheral aspect of the circular housing defining the exit. An impeller contained within a handle of the apparatus directs a flow of air through the plenum of a circular housing. The airflow then exits the plenum through a peripheral outlet thereby inducing additional airflow from the ambient air adjacent the mouth of the circular housing and through an axial passageway to impinge upon the bubble ring containing a bubble solution retained in the slots between adjacent fins thereby creating a plurality of bubbles.

Referring now to FIGS. 1-4, a bladeless bubble fan 100 is illustrated wherein the fan 100 has a housing 110 formed as a circular outer shell 112 and a handle shell 114 depending therefrom. A handle cover 116 mates with the handle shell 114 and retains therein a motor casing 130 retaining an electric motor 132 and an air impeller 134 therein. The handle shell 114 and the handle cover 116 each define a plurality of inlet apertures 118 to permit air to flow therethrough and exit from an upper portion of the handle formed by the handle shell 114 and the handle cover 116. The handle shell 114 further defines a battery cavity 120 below the electric motor casing 130 and contains a plurality of battery contacts 124 electrically interconnecting a plurality of batteries 122 for powering the motor 134. A switch 128 is connected within the circuitry formed by the interconnection of batteries 122, electrical contacts 124 and motor 134 to selectively activate motor 134 between an "ON" state and an "OFF" state in a manner known in the art. A battery cover 126 is selectively removable from the handle shell 114 to provide access to the interior of the battery cavity 120 for removal and replacement of the batteries 122.

Figure 5:
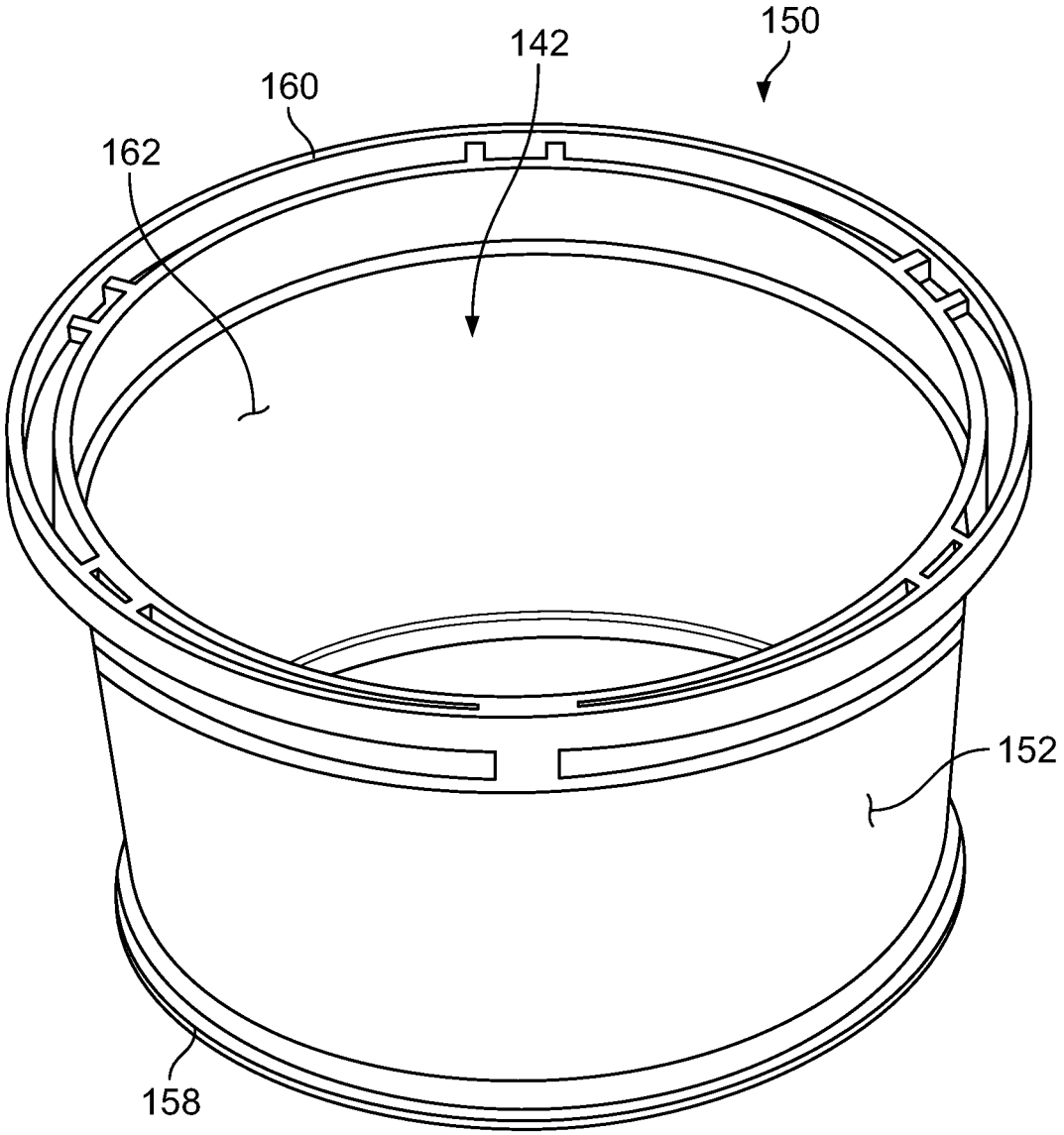
FIG. 5 presents an isometric view of the air guide.

The circular outer shell 112 receives a circular air guide 150 (FIG. 5) which is coaxially aligned with the circular the outer shell 112 along an axis 106. An inner surface 136 of the outer shell 112 and an outer surface 152 of the air guide 150 combine to define a circular plenum 154 extending about the circumference of the air guide 150 and fluidly communicative with the impeller 134. The outer shell 112 and air guide further define a mouth 140 at an air inlet end and an airflow exit 182 at an air outlet end with an air passageway 142 extending along axis 106. A leading edge 158 of the air guide 150 is spaced from the outer shell 112 to form a peripheral air outlet 156 for the circular plenum 154 for air exit into the air passageway 142. The air outlet 156 is formed to direct the airflow therethrough into the air passageway 142 and toward the airflow exit 182.

Figure 6:
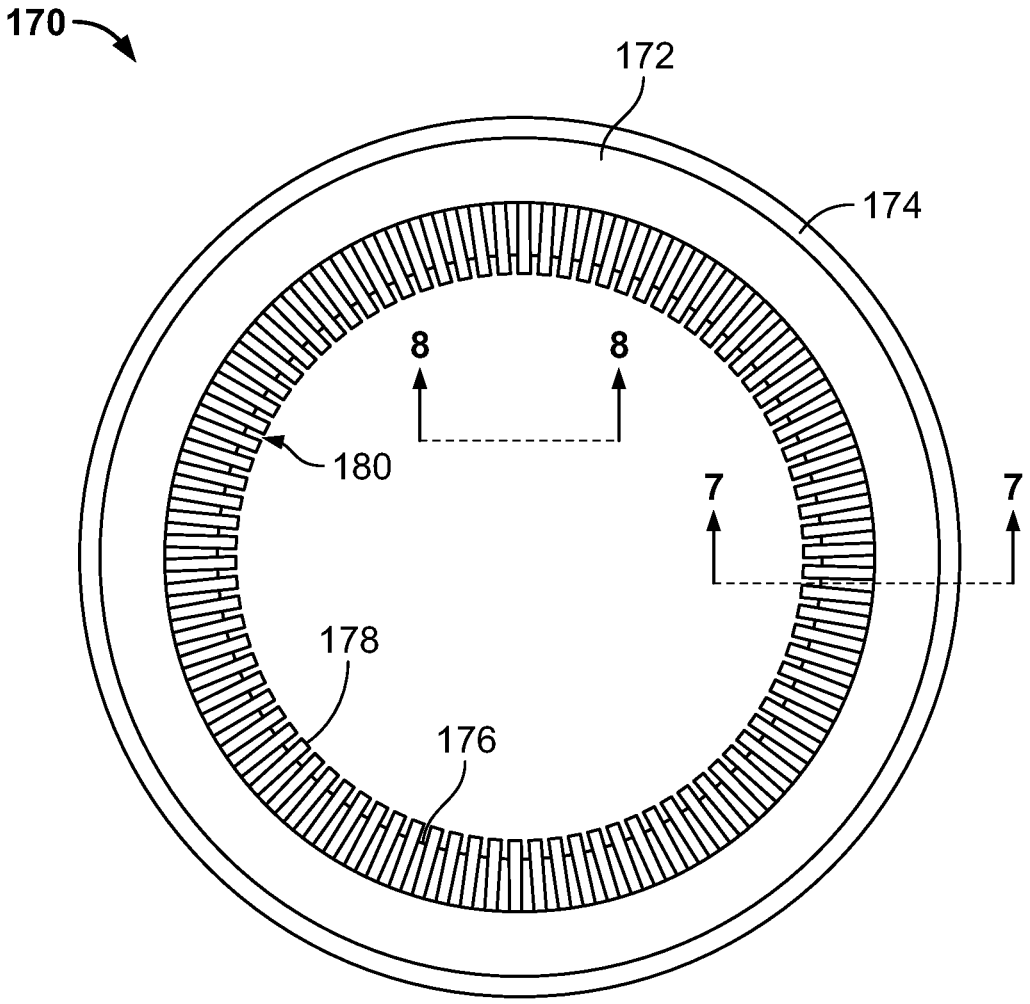
FIG. 6 presents an end elevation view of the bubble ring
Figure 7:
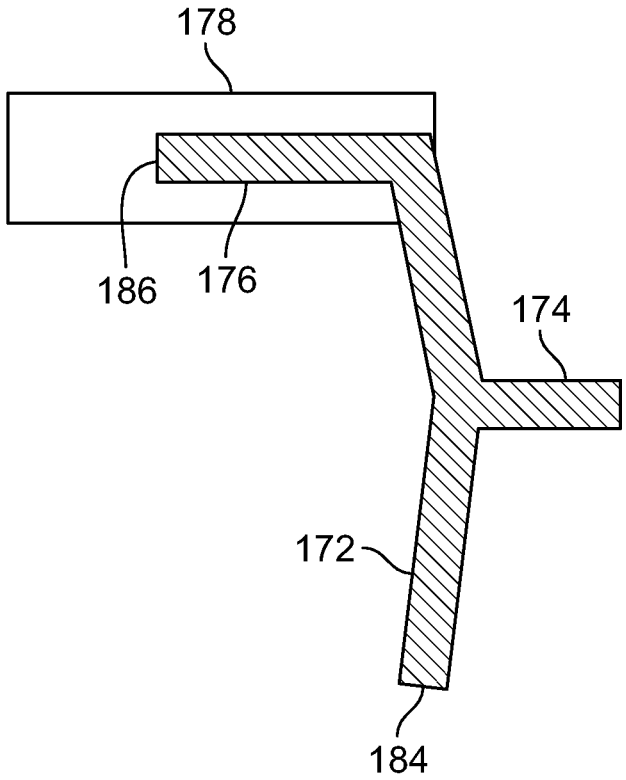
FIG. 7 presents a partial cross-sectional view of the bubble ring shown in FIG. 6 and taken along the line 7-7, FIG. 6.
Figure 8:
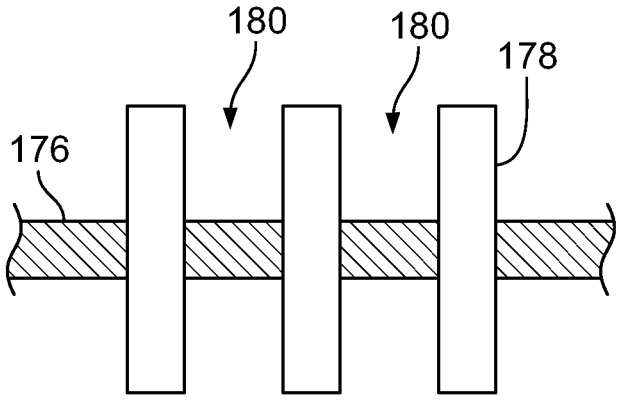
FIG. 8 presents a segmental view of the bubble ring shown in FIG. 6 and taken along the line 8-8, FIG. 6 illustrating adjacent fins molded onto the inner flange.

A bubble ring 170 (FIGS. 6-8) is affixed to a trailing edge 160 of the air guide 150 and is coaxial therewith. The bubble ring 170 has a circular wall 172 and a horizontal outer flange 174 extending radially outward therefrom. A lower portion 184 of the circular wall in combination with the outer flange 174 engage the trailing edge 160 of the air guide 150 to securely retain the bubble ring 170 to the air guide 150. The manner of engagement can be one of multiple configurations known in the art. An upper flange 176 extends radially inwardly from the circular wall 172 and has formed thereon a plurality of closely spaced fins 178. Each fin 178 extends along a radial line from the axis 106 such that adjacent ones of the fins 178 define a slot therebetween and extend inwardly beyond an inner edge 186 of the flange 176 and below the flange 176. In such manner, the plurality of fins 178 extends into the air passageway 142 in a radial direction with respect to axis 106.

Figure 9:
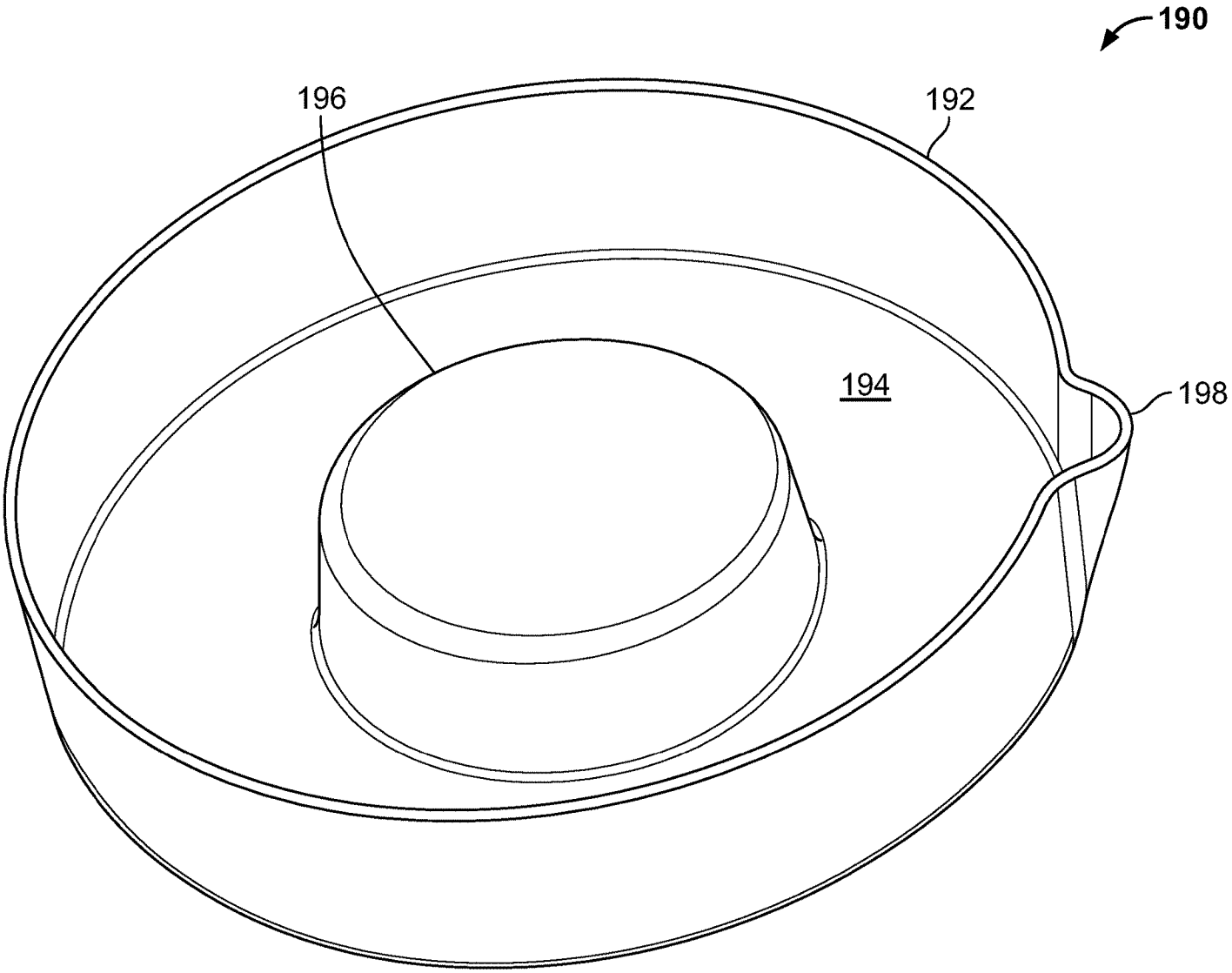
FIG. 9 presents an isometric view of the bubble pan removed from the bladeless bubble fan.

Referring to FIG. 9, a bubble pan 190 has a floor 194, a circular outer wall 192 and a central column 196 to form a trough 197 for receiving a liquid bubble solution. The outer wall 192 is sized and configured to engage the outer portion of the trailing edge 160 of the air guide 150 in a manner known in the art such as to be selectively attachable and detachable from the trailing edge 160. The outer wall 192 can also have formed therein one or more spouts for a controlled pouring of liquid such as a liquid bubble solution from the trough 197 into a container.

In use, an individual desiring to create bubbles for enjoyment or play can utilize the bladeless bubble fan 100 by removing the battery cover 126 from the handle shell 114 and inserting the correct number and size of batteries in the battery cavity 120. The battery cover 126 is then replaced in the handle shell 114. The bubble pan 190 is detached from the bladeless bubble fan 100 and placed on a horizontal surface. A quantity of liquid bubble solution is poured into the trough 197 of the bubble pan 190. The quantity of liquid bubble solution is sufficient great enough that the bubble ring 170 can be immersed in the liquid.

The bladeless bubble fan 100 is then raised and held upright. A quantity of liquid bubble solution is retained in the slots 180 between adjacent ones of the fins 178 of the bubble ring 170. The switch 128 is activated to engage the motor 132. The motor 132 rotates the impeller 134 creating airflow from inlet apertures 118 up through an interior of the handle formed by handle shell 114 and handle cover 116. The airflow then is directed into the circular plenum 154 and exits the plenum 154 through the peripheral air outlet 156 defined by the leading edge 158 of the air guide 150 and the circular outer shell 112. The airflow exiting the peripheral air outlet 156 is directed through the air passageway 142 and further induces ambient air to enter the mouth 140 and combine with the airflow from the peripheral air outlet 156. The combined airflow is then axially directed at the plurality of fins 178 and slots 180 retaining liquid bubble solution therebetween. As the airflow impinges on the liquid retained by the fins 178 and slots 180, the surface tension of the liquid and the airflow combine to create a plurality of bubbles until the liquid bubble solution is depleted. The switch 128 is then disengaged to turn the motor 132 "OFF".

At this time the fins 178 of the bubble ring 170 can be re-immersed in the liquid bubble solution in the bubble pan 190 and the process repeated to create more bubbles until use of the bladeless bubble fan 100 is completed. Once use is completed, excess liquid bubble solution can be poured from the bubble pan 190 back into a container using spout 198, and the bubble pan 190 is again affixed to the trailing edge 160 of the air guide 150 until the user desires to again create bubbles for play and enjoyment.

Although the forgoing detailed description is directed to a bladeless bubble fan embodiment, including preferred embodiments with a circular housing 110 and a circular air guide 150 defining a circular air passageway having a handle extending therefrom, those practiced in the art will readily recognize that the housing 110, air guide 150, and bubble ring 170 can be formed as any closed geometric shape, but not limited to, such as an oval, an ellipse, a rectangle, a pentagon, a hexagon, or an octagon, or an open geometric shape Likewise the bubble pan 190 would be similarly shaped to receive therein the closed geometric shape of the housing 110 and air guide 150. Further, the impeller 134 and driving motor 132 need not be in a handle 114 of the bladeless bubble fan 100, nor does the Bladeless bubble fan 100 need a handle 114. The motor 132 and impeller 134 can be housed within the housing 110, or a stationary base (not shown).

The above description is considered that of certain embodiments of the present invention only. Modifications of the invention will occur to those skilled in the art and to those who make or use the invention. Therefore, it is to be understood that the embodiments described herein are merely for illustrative purposes only and are not intended to limit the scope of the invention hereof.

We claim:

1. A bladeless bubble fan comprising:

a housing defining a plurality of inlets and having enclosed therein an impeller for drawing air through the inlets from an exterior thereof, at least a portion of the housing forming a closed geometrically shaped outer shell and defining an axial passageway therethrough;

an inner air guide received in the housing and coaxial with the closed geometrically shaped outer shell and in combination with the closed geometrically shaped outer shell defining a circular plenum therebetween in fluidic communication with an output of the impeller and further defining a peripheral outlet of the plenum; and a bubble ring affixed to the inner air guide and coaxial therewith, the bubble ring having a plurality of closely spaced fins extending inwardly toward an axis of the axial passageway.

2. The bladeless bubble fan according to claim 1 wherein the housing includes a handle extending from the closed geometrically shaped outer shell.

3. The bladeless bubble fan according to claim 2 wherein the inlets are defined in the handle and the impeller is mounted in the handle.

4. The bladeless bubble fan according to claim 3 wherein an electric motor is mounted in the handle and oriented to drive the impeller.

5. The bladeless bubble fan according to claim 1 wherein the peripheral outlet of the plenum is defined by a leading edge of the closed geometrically shaped outer shell and a leading edge of the inner air guide.

6. The bladeless bubble fan according to claim 5 wherein the peripheral outlet is oriented to direct airflow from the peripheral outlet through the axial passageway.

7. The bladeless bubble fan according to claim 1 wherein the bubble ring is affixed at an outlet of the axial passageway.

8. The bladeless bubble fan according to claim 7 wherein the bubble ring includes an inner flange extending inwardly toward the axis of the axial passageway.

9. The bladeless bubble fan according to claim 8 wherein the plurality of closely spaced fins are formed upon the inner flange and radially aligned with the axis of the axial passageway.

10. The bladeless bubble fan according to claim 9 wherein adjacent ones of the closely spaced fins define a slot therebetween for receiving and retaining a liquid bubble solution.

11. The bladeless bubble fan according to claim 1 further including a bubble pan attached to and selectively detachable from a trailing edge of the inner air guide for receiving a liquid bubble solution.

12. A bladeless bubble fan comprising:

a housing defining a plurality of inlets and having enclosed therein an impeller for drawing air through the inlets from an exterior thereof, at least a portion of the housing forming a closed geometrically shaped outer shell defining an axial passageway therethrough;

an inner air guide received in the housing and coaxial with the closed geometrically shaped outer shell and in combination with the closed geometrically shaped outer shell defining a plenum therebetween in fluidic communication with an output of the impeller wherein a leading edge of the closed geometrically shaped outer shell and a leading edge of the inner air guide define a peripheral outlet of the plenum; and a bubble ring affixed to the inner air guide at an outlet of the axial passageway and coaxial therewith, the bubble ring having a plurality of closely spaced fins extending inwardly toward an axis of the axial passageway.

13. The bladeless bubble fan according to claim 12 wherein the housing includes a handle extending from the closed geometrically shaped outer shell.

14. The bladeless bubble fan according to claim 13 wherein the inlets are defined in the handle and wherein an electric motor and the impeller rotatingly attached thereto are mounted in the handle.

15. The bladeless bubble fan according to claim 12 wherein the peripheral outlet is oriented to direct airflow from the peripheral outlet through the axial passageway.

16. The bladeless bubble fan according to claim 12 wherein the bubble ring includes an inner flange extending inwardly toward the axis of the axial passageway.

17. The bladeless bubble fan according to claim 16 wherein the plurality of closely spaced fins are formed upon the inner flange and radially aligned with the axis of the axial passageway and further wherein adjacent ones of the closely spaced fins define a slot therebetween for receiving and retaining a liquid bubble solution.

18. The bladeless bubble fan according to claim 12 further including a bubble pan attached to and selectively detachable from the trailing edge of the inner circular air guide, the bubble pan defining a trough for receiving a liquid bubble solution.

19. A bladeless bubble fan, comprising:

a toy for creating bubbles, said toy comprising a housing defining an axial passageway therethrough and further having a handle including an impeller embedded therein for movement of air through the axial passageway, wherein the impeller is displaced from the axial passageway for creating bubbles without the use of blades within the axial passageway for moving air to create the bubbles.

* * * * *